US006973805B2

(12) United States Patent
Higashiyama

(10) Patent No.: US 6,973,805 B2
(45) Date of Patent: Dec. 13, 2005

(54) LAYERED HEAT EXCHANGER, LAYERED EVAPORATOR FOR MOTOR VEHICLE AIR CONDITIONERS AND REFRIGERATION SYSTEM

(75) Inventor: Naohisa Higashiyama, Oyama (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 10/471,227

(22) PCT Filed: Mar. 14, 2002

(86) PCT No.: PCT/JP02/02395

§ 371 (c)(1),
(2), (4) Date: Sep. 9, 2003

(87) PCT Pub. No.: WO02/073114

PCT Pub. Date: Sep. 19, 2002

(65) Prior Publication Data

US 2005/0126770 A1 Jun. 16, 2005

Related U.S. Application Data

(60) Provisional application No. 60/302,689, filed on Jul. 5, 2001.

(30) Foreign Application Priority Data

Mar. 14, 2001 (JP) ..... 2001-71537

(51) Int. Cl.[7] ..... F25B 39/02; F28F 9/22

(52) U.S. Cl. ..... 62/525; 165/153; 165/174

(58) Field of Search ..... 165/153, 174, 165/176; 62/525, 526

(56) References Cited

U.S. PATENT DOCUMENTS

| | | | | |
|---|---|---|---|---|
| 3,706,534 | A * | 12/1972 | Verheul et al. | 165/174 |
| 5,979,544 | A * | 11/1999 | Inoue | 165/153 |
| 6,059,026 | A * | 5/2000 | Bailly et al. | 165/174 |
| 6,145,587 | A * | 11/2000 | Hanafusa | 165/153 |
| 6,220,342 | B1 * | 4/2001 | Nishishita et al. | 165/153 |
| 6,338,383 | B1 * | 1/2002 | Abdulnour et al. | 165/153 |
| 6,382,313 | B2 * | 5/2002 | Mitsumoto et al. | 165/174 |

FOREIGN PATENT DOCUMENTS

| | | |
|---|---|---|
| JP | 62-63596 | 4/1987 |
| JP | 3-30066 | 3/1991 |
| JP | 6 123581 | 5/1994 |
| JP | 11-132596 | 5/1999 |
| JP | 2000-193392 | 7/2000 |
| JP | 2002-107083 | 4/2002 |

* cited by examiner

*Primary Examiner*—Leonard R. Leo
(74) *Attorney, Agent, or Firm*—Oblon, Spivak, McClelland, Maier & Neustadt, P.C.

(57) ABSTRACT

An end plate (20) has a fluid inlet hole (27) communicating with a front header (12*b*) and covered with a fluid diffusing portion (60) which is in the form of a semispherical plate and which has small holes (60*a*).

12 Claims, 5 Drawing Sheets

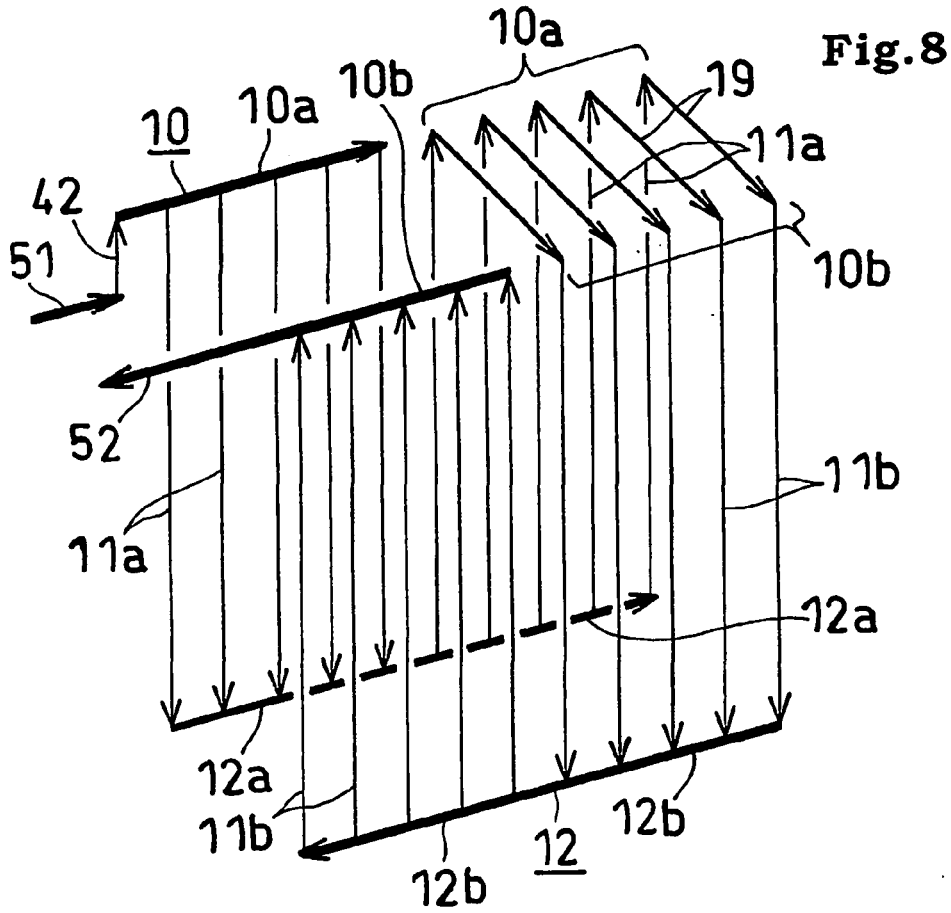
Fig.8
Fig.9
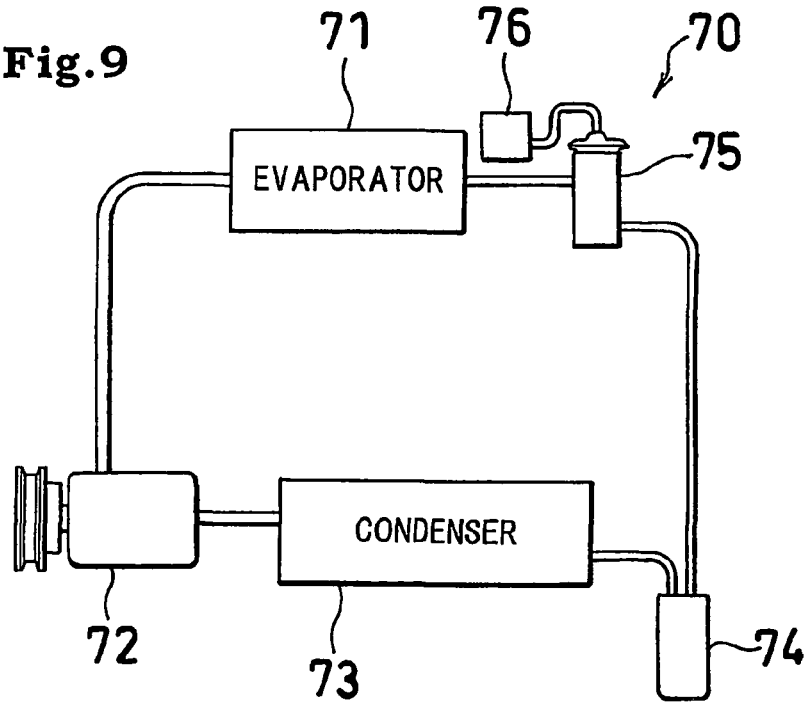

LAYERED HEAT EXCHANGER, LAYERED EVAPORATOR FOR MOTOR VEHICLE AIR CONDITIONERS AND REFRIGERATION SYSTEM

CROSS REFERENCE TO RELATED APPLICATIONS

This application is an application filed under 35 U.S.C. §111(a) claiming the benefit pursuant to 35 U.S.C. §119(e)(1) of the filing data of Provisional Application No. 60/302,689 filed Jul. 5, 2001 pursuant to 35 U.S.C. §111(b).

TECHNICAL FIELD

The present invention relates to layered heat exchangers, layered evaporators for motor vehicle air conditioners and refrigeration systems.

The terms "upper," "lower," "left" and "right" as used herein refer respectively to the upper and lower sides, and left- and right-hand sides of FIG. 1, the term "front" refers to the front side of the plane of the same drawing, and the term "rear" to the rear side thereof. However, the terms front, rear, left and right are used for convenience sake, and may be used in reverse relation to the above. Further the fluid inlet and outlet can be used as reversed.

BACKGROUND ART

The conventional layered heat exchangers for use as layered evaporators for motor vehicle air conditioners include two types; one wherein headers are provided at one of the upper and lower sides of the exchanger, and the other wherein headers are provided at both of the upper and lower sides.

Conventional heat exchangers comprise, for example, intermediate plates each provided in one side thereof with a tube forming recessed portion and header forming recessed portions having a larger depth than this portion and continuous with at least one of the upper and lower sides thereof. Each of the header forming recessed portions has a fluid passage hole formed in its bottom wall. The intermediate plates are fitted together in juxtaposed layers, with the recessed portions of each plate opposed to the corresponding recessed portions of the plate immediately adjacent thereto to thereby provide juxtaposed flat tubes and headers in communication with the flat tubes. An end plate is provided at each of the left and right sides of the plate arrangement externally thereof.

With the layered heat exchanger described above, it is important to distribute a fluid from the header to the flat tubes uniformly. Uniformly divided flows of the fluid are formed, for example, by adjusting the number of flat tubes. However, this method encounters the problem of failing to divide the fluid fully uniformly or attaining uniform division of the fluid at the sacrifice of channel resistance to the fluid.

For this reason, the problem of an insufficient cooling efficiency arises when such a layered heat exchanger is used as the evaporator for motor vehicle air conditioners. Further in the case where such a layered heat exchanger is used as the evaporator to provide a refrigeration system which comprises a compressor for compressing a refrigerant, a condenser for condensing the compressed refrigerant, a pressure reducing device for passing the condensed refrigerant therethrough for a pressure reduction, and an evaporator for evaporating the refrigerant from the device to return the resulting refrigerant to the compressor, the refrigeration system has the problem of being insufficient in overall efficiency since the evaporator is insufficient in the function of diffusing the refrigerant therethrough.

An object of the present invention is to provide a layered heat exchanger wherein the refrigerant can be allowed to flow out of the header into flat tubes in uniformly divided streams.

Another object of the present invention is to provide a layered evaporator for motor vehicle air conditioners wherein the refrigerant can be allowed to flow out of the header into flat tubes in uniformly divided streams and which is therefore improved in cooling efficiency.

Another object of the invention is to provide a refrigeration system which is improved in overall efficiency by incorporating therein a layered heat exchanger wherein the refrigerant can be allowed to flow out of the header into flat tubes in uniformly divided streams.

DISCLOSURE OF THE INVENTION

The present invention provides a layered heat exchanger comprising a multiplicity of intermediate plates arranged side by side, and a pair of end plates disposed respectively at left and right sides of the arrangement, each of the intermediate plates having an upper header forming portion provided with a pair of front and rear fluid passage holes and a tube forming recessed portion, the multiplicity of intermediate plates being fitted together in juxtaposed layers, with the recessed portion of each intermediate plate opposed to the recessed portion of the intermediate plate immediately adjacent thereto to thereby provide juxtaposed flat tubes and a front and a rear upper header interconnecting the flat tubes, one of the end plates having a fluid inlet through hole in communication with one of the front and rear upper headers and a fluid outlet through hole in communication with the other upper header, the layered heat exchanger being characterized in that at least one of the inlet hole and the outlet hole formed in the end plate is at least partly covered with a fluid diffusing portion having a plurality of small holes.

With the layered heat exchanger of the present invention, the division of the fluid from the upper header into the flat tubes is adjusted by the fluid diffusing portion, with the result that uniformly divided flows of fluid are available to achieve a greatly increased heat exchange efficiency.

The layered heat exchanger of the present invention has, for example, the following through holes.

One of the two through holes may be covered with the fluid diffusing portion, or each of the two through holes may be covered with the fluid diffusing portion. For example, the fluid diffusing portion is provided first for the fluid inlet through hole, and if the required level is thereby reached, the inlet hole only is provided with the diffusing portion, whereas when a higher efficiency is required, the fluid diffusing portion is provided also for the fluid outlet through hole. In the case where the two holes are each covered with the diffusing portion, the fluid diffusing portions may be the same or different in construction.

The fluid diffusing portion may be disposed at the lower half of each of the through holes. The outflow from the upper half and the outflow from the lower half then become asymmetric, whereby a greater diffusing effect is available.

The through hole covered with the fluid diffusing portion may be circular, with the fluid diffusing portion given a spherical surface. The fluid then flows out of the small holes in varying directions including upward and downward directions, whereby an improved diffusing effect can be achieved.

The through hole covered with the fluid diffusing portion may be circular, with the fluid diffusing portion in the form of a disk. This ensures facilitated work for forming the fluid diffusing portion on the end plate.

The through hole covered with the fluid diffusing portion may be circular, with the fluid diffusing portion in the form of an annular portion covering a peripheral portion of the hole. The through hole may then have a central portion in the form of a nozzle. It is then possible to adjust the outflow of the fluid from the central portion and the fluid outflow from the peripheral portion individually. This leads to increased freedom of design and a higher diffusing effect.

The present invention further provides a layered evaporator for motor vehicle air conditioners which comprises a multiplicity of intermediate plates arranged side by side, and a pair of end plates disposed respectively at left and right sides of the arrangement, each of the intermediate plates having an upper header forming portion provided with a pair of front and rear fluid passage holes and a tube forming recessed portion, the multiplicity of intermediate plates being fitted together in juxtaposed layers, with the recessed portion of each intermediate plate opposed to the recessed portion of the intermediate plate immediately adjacent thereto to thereby provide juxtaposed flat tubes and a front and a rear upper header interconnecting the flat tubes, one of the end plates having a fluid inlet through hole in communication with one of the front and rear upper headers and a fluid outlet through hole in communication with the other upper header, the layered evaporator being characterized in that at least one of the two through holes formed in the end plate is at least partly covered with a fluid diffusing portion having a plurality of small holes.

With the layered evaporator of the present invention for use in motor vehicle air conditioners, the division of the fluid from the upper header into the flat tubes is adjusted by the fluid diffusing portion, with the result that uniformly divided flows of fluid are available to achieve a greatly increased cooling efficiency.

The present invention provides a refrigeration system comprising a compressor for compressing a refrigerant, a condenser for condensing the compressed refrigerant, a pressure reducing device for passing the condensed refrigerant therethrough for a pressure reduction, and an evaporator having a refrigerant diffusing function for evaporating the refrigerant from the device to return the resulting refrigerant to the compressor, the evaporator comprising a multiplicity of intermediate plates arranged side by side, and a pair of end plates disposed respectively at left and right sides of the arrangement, each of the intermediate plates having an upper header forming portion provided with a pair of front and rear fluid passage holes and a tube forming recessed portion, the multiplicity of intermediate plates being fitted together in juxtaposed layers, with the recessed portion of each intermediate plate opposed to the recessed portion of the intermediate plate immediately adjacent thereto to thereby provide juxtaposed flat tubes and a front and a rear upper header interconnecting the flat tubes, one of the end plates having a fluid inlet through hole in communication with one of the front and rear upper headers and a fluid outlet through hole in communication with the other upper header, the refrigeration system being characterized in that at least one of the two through holes formed in the end plate is at least partly covered with a fluid diffusing portion having a plurality of small holes.

With the refrigeration system of the present invention, the division of the fluid from the upper header into the flat tubes in the evaporator is adjusted by the fluid diffusing portion, with the result that uniformly divided flows of fluid are available for the overall system to achieve a greatly increased efficiency.

The layered evaporator of the present invention for use in motor vehicle air conditioners and the refrigeration system of the invention have, for example, the following through holes.

One of the two through holes may be covered with the fluid diffusing portion, or each of the two through holes may be covered with the fluid diffusing portion. For example, the fluid diffusing portion is provided first for the fluid inlet through hole, and if the required level is thereby reached, the inlet hole only is provided with the diffusing portion, whereas when a higher efficiency is required, the fluid diffusing portion is provided also for the fluid outlet through hole. In the case where the two holes are each covered with the diffusing portion, the fluid diffusing portions may be the same or different in construction.

The fluid diffusing portion may be disposed at the lower half of each of the through holes. The outflow from the upper half and the outflow from the lower half then become asymmetric, whereby a greater diffusing effect is available.

The through hole covered with the fluid diffusing portion may be circular, with the fluid diffusing portion given a spherical surface. The fluid then flows out of the small holes in varying directions including upward and downward directions, whereby an improved diffusing effect can be achieved.

The through hole covered with the fluid diffusing portion may be circular, with the fluid diffusing portion in the form of a disk. This ensures facilitated work for forming the fluid diffusing portion on the end plate.

The through hole covered with the fluid diffusing portion may be circular, with the fluid diffusing portion in the form of an annular portion covering a peripheral portion of the hole. The through hole may then have a central portion in the form of a nozzle. It is then possible to adjust the outflow of the fluid from the central portion and the fluid outflow from the peripheral portion individually. This leads to increased freedom of design and a higher diffusing effect.

BRIEF DESCRIPTION OF THE DRAWINGS

FIG. 8 is a flow chart schematically showing the overall arrangement of refrigerant flow channels in the device of the invention.

FIG. 9 is a block diagram schematically showing the construction of a system of the invention (refrigeration system).

BEST MODE OF CARRYING OUT THE INVENTION

Figure 1:
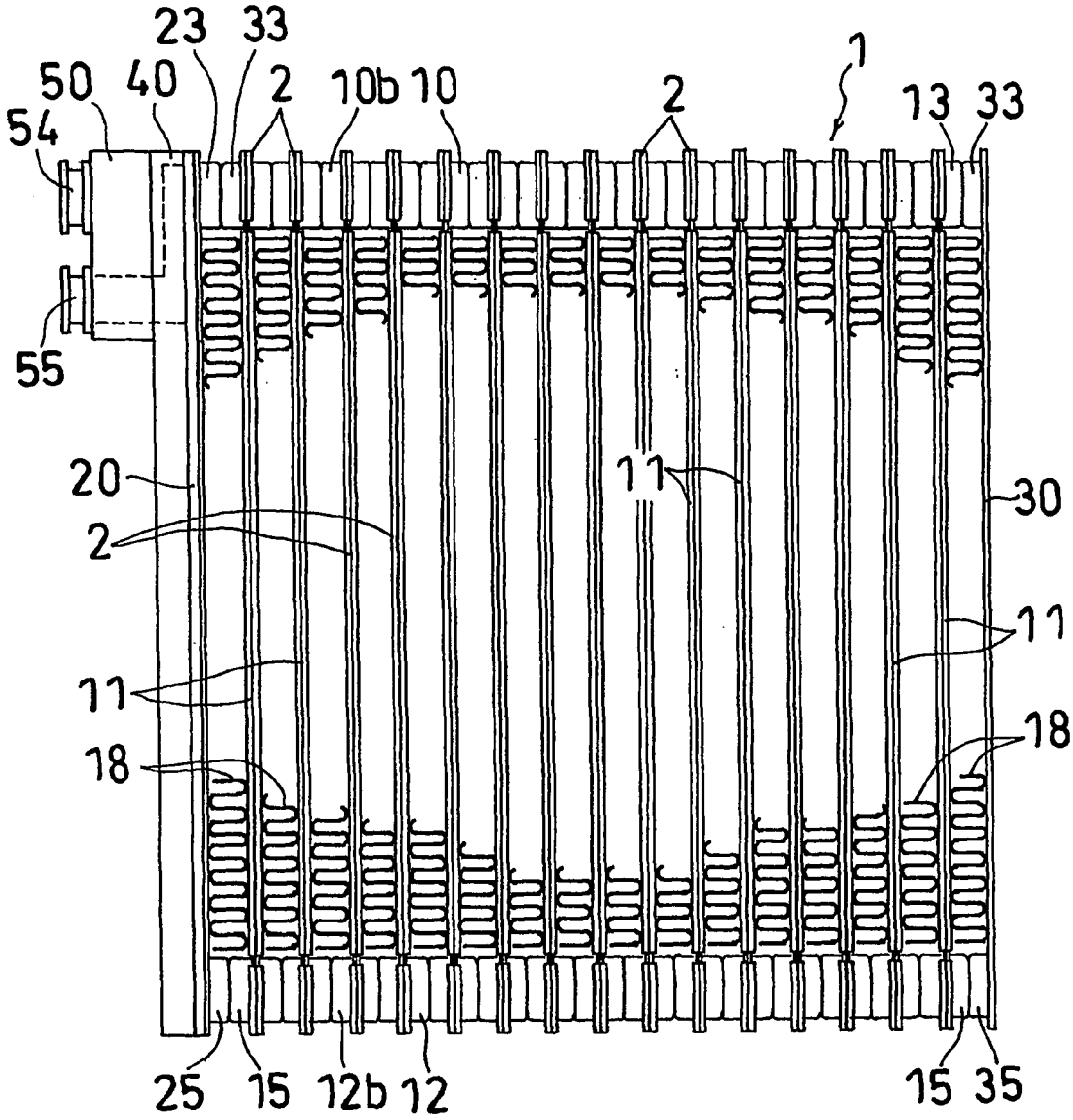
FIG. 1 is a front view schematically showing a device of the invention (layered heat exchanger or layered evaporator for use in motor vehicle air conditioners).
Figure 2:
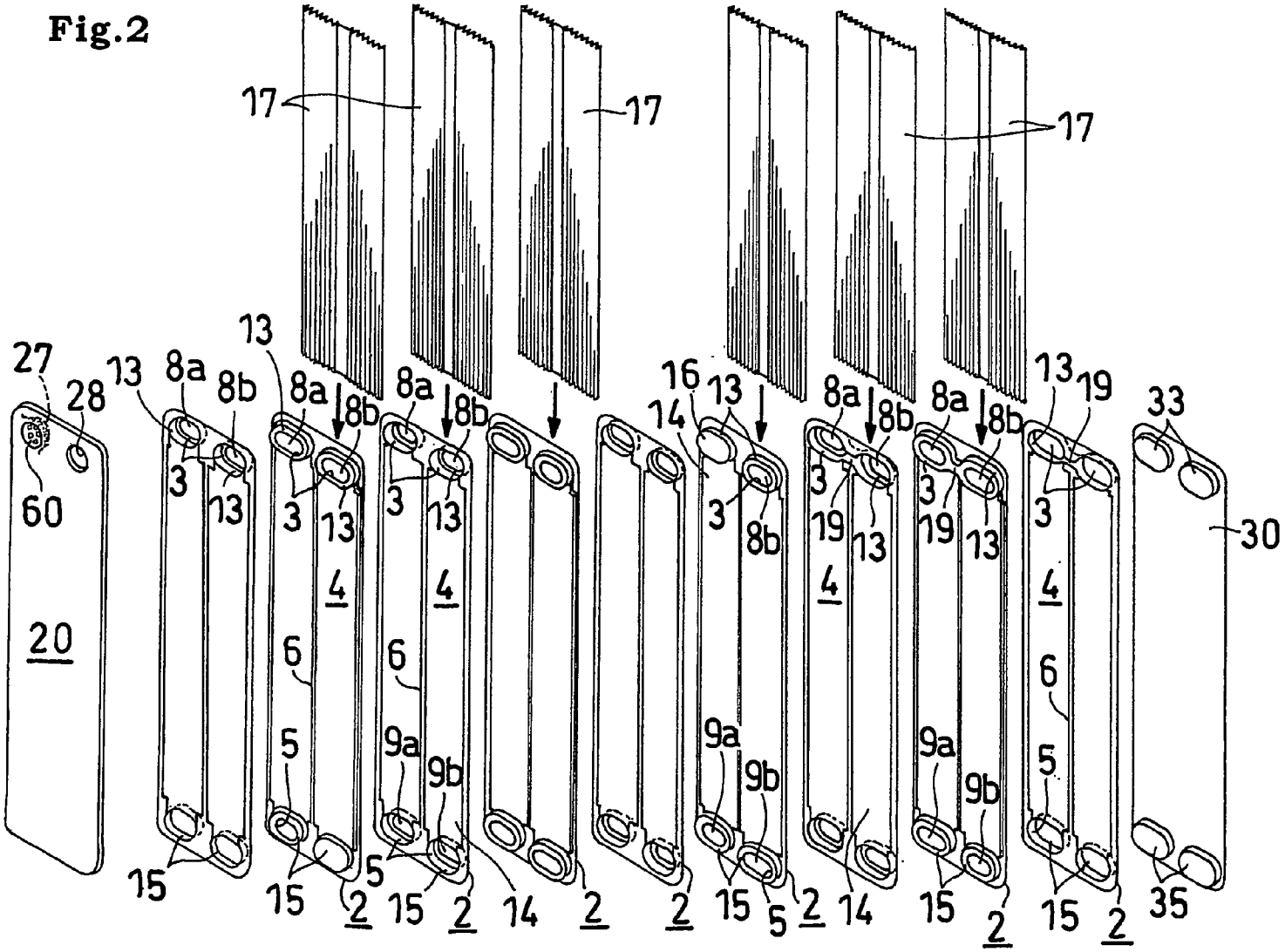
FIG. 2 is an exploded perspective view schematically showing the device of the invention.

With reference to FIGS. 1 to 4, embodiments of layered heat exchanger of the invention will be described next. The drawings show the present invention as applied to layered evaporators for use in motor vehicle air conditioners.

The layered evaporator 1 is made from aluminum (including an aluminum alloy) and comprises a multiplicity of intermediate plate 2 arranged side by side and end plates 20, 30 which are arranged at the left and right sides of the arrangement externally thereof. The evaporator 1 is generally rectangular when seen from the front.

Each of the intermediate plates 2 has on one side thereof a pair of front and rear cuplike projections 13, 15 formed at the upper and lower ends thereof and having header recesses 3, 5 inside thereof respectively. The plate 2 is provided at an intermediate portion of the height ther of with a bulging portions 14 having inside thereof a tube recess 4 continuous with the header recesses 3, 5. The tube recess 4 is divided into front and rear two portions by a vertically elongated partition ridge 6 provided centrally of the recess 4.

Refrigerant passage holes 8*a*, 8*b*, 9*a*, 9*b* each in the form of a forwardly or rearwardly elongated circle are formed in the outer ends of the front and rear cuplike projections 13, 13, 15, 15 of the intermediate plate 2 at the upper and lower ends thereof. All the intermediate plates 2 are fitted together in juxtaposed layers, with the recesses 3, 4, 5 of each plate 2 opposed to the corresponding recesses of another plate immediately adjacent thereto to thereby provide front and rear flat tubes 11 arranged side by side and front and rear, upper and lower headers 10, 12 respectively joining the upper and lower end portions of the flat tubes 11. An inner fin 17 is enclosed in each flat tube 11. A corrugated fin 18 is interposed between each pair of adjacent flat tubes 11, 11 or between each end plate 20 or 30 and the side flat tube 11 adjacent thereto.

A refrigerant inlet through hole 27 is formed in a rear portion of the left end plate 20 close to the upper end thereof, and a refrigerant outlet through hole 28 is formed in a front portion of the same end plate 20 close to the upper end thereof. An aluminum flange 40 which is generally rectangular when seen sideways is attached to the outer surface of upper end portion of the left side plate 20. A pipe end connecting block 50 is attached to the outer surface of the flange 40 in a rearwardly downward inclined position. The connecting block 50 is provided with a refrigerant inlet pipe socket 54 and a refrigerant outlet pipe socket 55.

Figure 3:
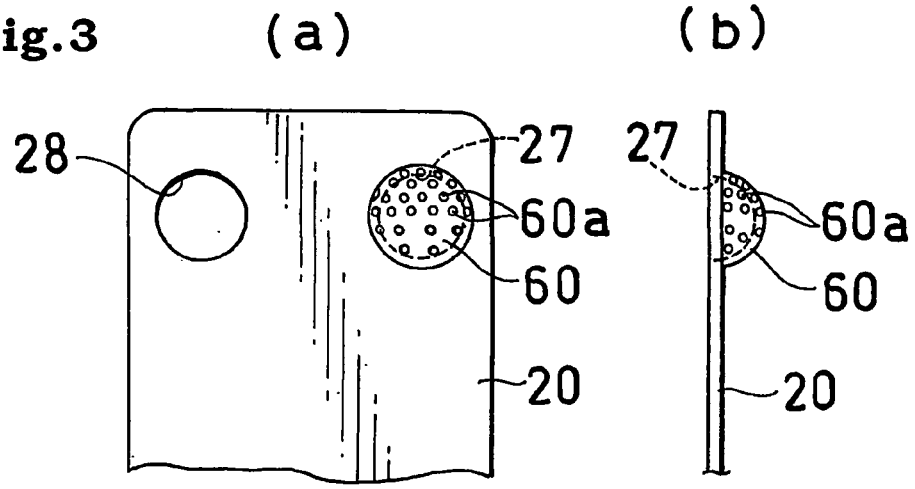
FIG. 3 includes enlarged fragmentary views of an end plate of the device of the invention.
Figure 4:
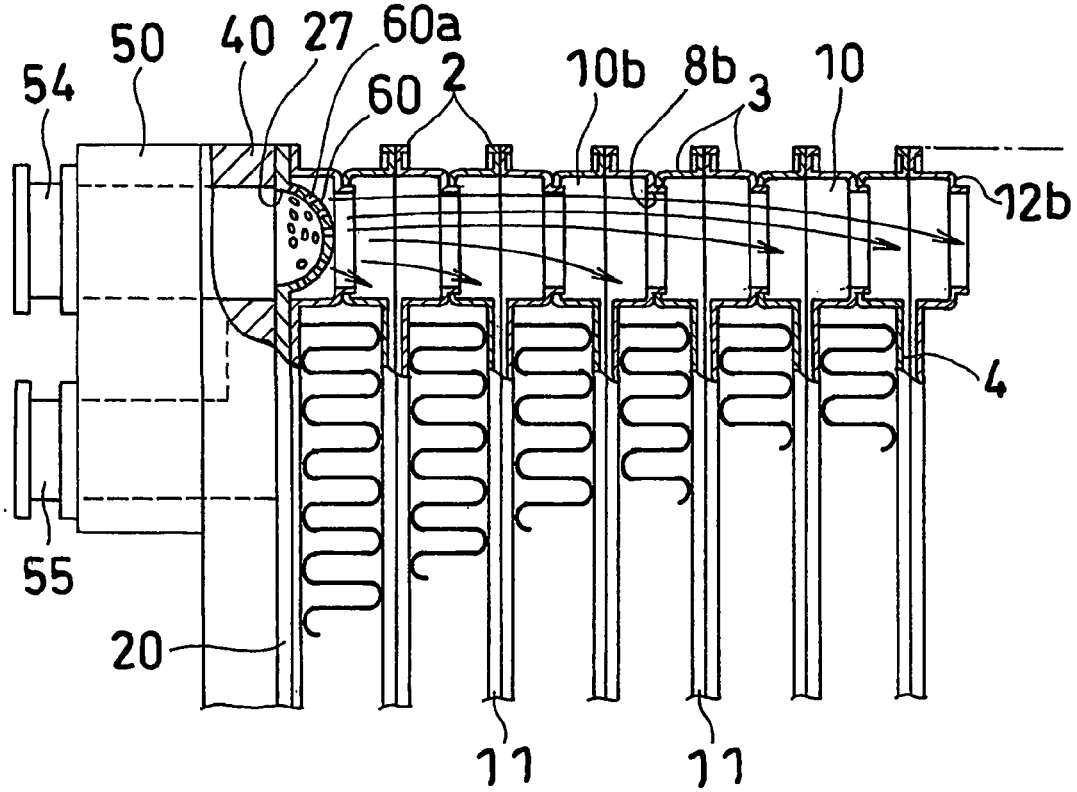
FIG. 4 is an enlarged fragmentary side elevation partly broken away and showing the device of the invention.

As shown in FIGS. 3 and 4 on an enlarged scale, the refrigerant inlet hole 27 formed in the left end plate 20 is covered with a refrigerant diffusing portion 60 in the form of a semispherical plate bulging toward the direction of injection of the refrigerant and having small holes 60*a* as uniformly distributed.

No refrigerant passage hole is formed in the bottom wall of the rear upper header recess 3 of the intermediate plate 2 at the midportion of the evaporator 1 along the left-to-right, i.e., lateral, direction thereof, among the other juxtaposed intermediate plates 2. The recess 3 has a partition wall 16 for dividing the rear upper header 10*a* into left and right two portions.

In the right half of the evaporator 1, the front and rear header recesses 3, 3 of each intermediate plate 2 are held in communication with each other by a communication passageway 19. This permits the refrigerant to flow from the right half of the rear upper header 10*a* through these passageways 19 into the right half of the front upper header 10*b*.

Among the components of the layered evaporator 1 described, the intermediate plates 2, and the left and right end plates 20, 30 are made from an aluminum brazing sheet, while the inner fins 17, corrugated fins 18, flange 40 and pipe end connecting block 50 are made from aluminum. The side plate 20 provided with the refrigerant diffusing portion 60 is prepared by the same process as the intermediate plate 2 having the refrigerant passage holes 8*a*, 8*b*.

The evaporator 1 is fabricated by assembling all the components thereof and collectively brazing the assembly, for example, in a vacuum.

The refrigerant flows through the layered evaporator 1 in the manner to be described below with reference to FIG. 8. From a refrigerant inlet pipe (not shown) via a refrigerant inlet passageways 51, 42 in the block 50 and the flange 40, the refrigerant flows into the left end of the rear upper header 10*a* through the inlet hole 27 in the left end plate 20. The refrigerant flows through the left half of the rear upper header 10*a* until the fluid strikes against the partition wall 16 of the intermediate plate 2 at the lateral midportion of the evaporator 1 while flowing down the rear flat tubes 11*a* communicating with the rear upper header 10*a* to reach the left half of the rear lower header 12*a*. The refrigerant further flows into the right half of the rear lower header 12*a* and now flows upward through many rear flat tubes 11*a* in communication with the right half of the rear lower header 12*a* to reach the right half of the rear upper header 10*a*. In the right half of the evaporator 1, the front and rear header recesses 3, 3 of each intermediate plate 2 are held in communication with each other by the passageway 19, so that the refrigerant flows from the right half of the rear upper header 10*a* through these communication passageways 19 to the right half of the front upper header 10*b* and further flows down many front flat tubes 11*b* communicating with the front upper header 10*b* to reach the right half of the front lower header 12*b*. The refrigerant then flows into the left half of the front lower header 12*b*, further flows upward through many front flat tubes 11*b* communicating with the left half of the front lower header 12*b* to reach the left half of the front upper header 10*b* and is discharged from the outlet hole 28 in the left end plate 20 to the outside via a refrigerant outlet passageway 52.

Since the refrigerant flows in the manner described above, the refrigerant flows in the largest quantity into the flat tube 11*a* which is positioned in the closest proximity to the inlet hole 27 and is likely to flow in unevenly divided streams through the layered evaporator 1 under the influence of gravity. According to the invention, however, the semispherical refrigerant diffusing portion 60 having small holes 60*a* and covering the refrigerant inlet hole 27 causes the refrigerant to be forced out in various directions orthogonal to the spherical surface, whereby the refrigerant is allowed to flow out of the rear upper header 10*a* into the rear flat tubes 11*a* in uniformly divided streams.

As shown in FIG. 1, for example, 15 pairs of intermediate plates 2 are used, and the partition wall 16 is provided in the rear upper header portion 10*a* provided by the middle pair of intermediate plates 2 (see FIG. 2), with the result that the refrigerant flows zigzag through the entire interior of the evaporator 1 and is run off from the outlet pipe to the outside.

On the other hand, an air stream (air) flows from the front rearward through the clearances between the adjacent flat tubes 11, 11 and between each of the end plates 20, 30 and the flat tube adjacent thereto, with the corrugated fins 18 provided in the respective clearances, to effect efficient heat exchange between the refrigerant and the air through the walls of the intermediate plates 2 and the corrugated fins 18.

With the layered evaporator 1 described, the divided flows of refrigerant from the rear upper header 10*a* into the rear flat tubes 11*a* can be adjusted according to the shape of the refrigerant diffusing portion 60 and the number of small holes 60*a* thereof. This makes it possible to produce uniformly divided refrigerant flows to achieve a greatly increased heat exchange efficiency.

Figure 5:
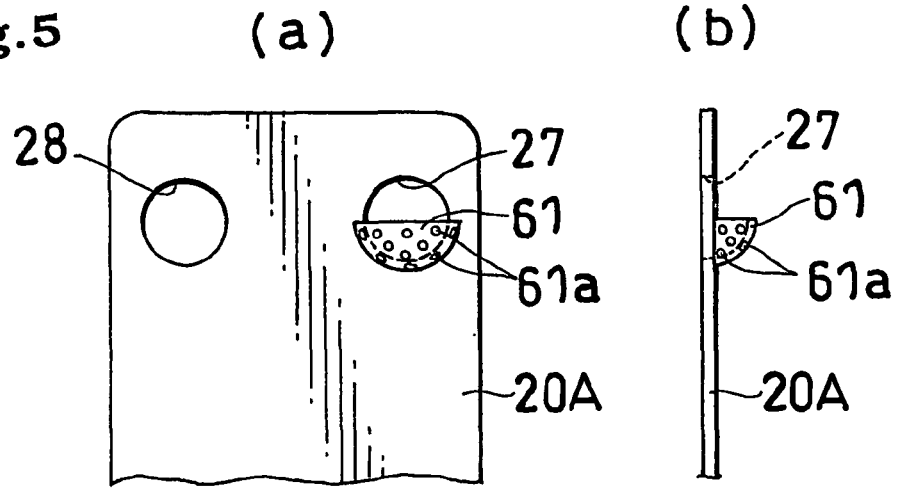
FIG. 5 includes enlarged fragmentary views of an end plate as a modified example for use in the device of the invention.
Figure 6:
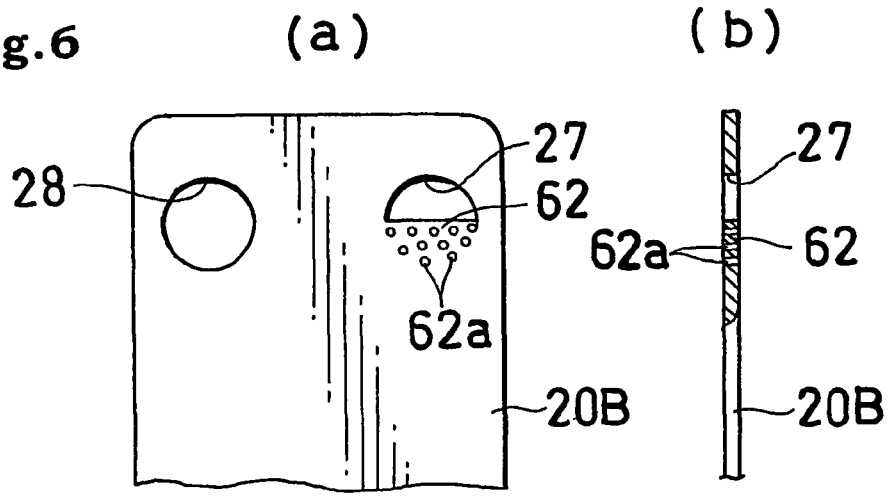
FIG. 6 includes enlarged fragmentary views of an end plate as another modified example for use in the device of the invention.
Figure 7:
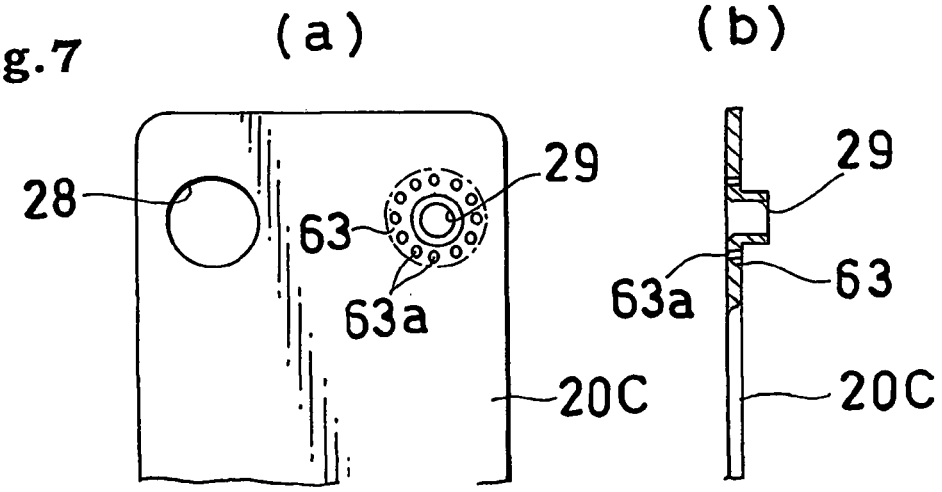
FIG. 7 includes enlarged fragmentary views of an end plate as a still another modified example for use in the device of the invention.

Thus, the shape of the refrigerant diffusing portion can be modified variously so as to produce uniformly divided refrigerant flows. FIGS. 5 to 7 show such examples.

FIG. 5 shows a refrigerant diffusing portion 61 which is formed by removing the upper half from the refrigerant diffusing portion 60 in the form of a semispherical plate and shown in FIG. 3. Consequently, the refrigerant inlet circular hole 27 is covered with the refrigerant diffusing portion 61 in the form of a quarter of a spherical surface which has uniformly distributed small holes 61*a* and bulges toward the direction of injection of the refrigerant. This diffusing portion 61 permits the refrigerant to be forced out of the upper half of the inlet hole 27 at a great flow rate and out of the lower half thereof toward various directions at a small flow rate, allowing the whole refrigerant to flow from the rear upper header 10*a* into the rear flat tubes 11*a* in uniformly divided streams.

FIG. 6 shows a refrigerant diffusing portion 62 for covering the lower half of the circular inlet hole 27. The diffusing portion 62 is in the form of a half of a disk having uniformly distributed small holes 62*a*. This refrigerant diffusing portion 62 permits the refrigerant to be forced out of the small holes 62*a* generally in the same direction. The refrigerant portions forced out of the respective small holes 62*a* differ in the maximum distance to be reached due to the difference between the small holes 62*a* in position. As a whole, the refrigerant is allowed to flow from the rear upper header 10*a* into the rear flat tubes 11*a* in uniformly divided streams.

FIG. 7 shows an annular refrigerant diffusing portion 63 having small holes 63*a* and covering an outer peripheral portion of the refrigerant inlet circular hole 27. The inlet hole 27 has a refrigerant inlet portion 29 in the form of a nozzle and positioned centrally thereof. According to this embodiment, the refrigerant is forced out of the inlet portion 29 at a great flow rate and is also forced out of the small holes 63*a* in the peripheral portion generally toward the same direction. The refrigerant portions forced out of the respective small holes 63*a* differ in the maximum distance to be reached due to the difference between the small holes 63*a* in position. As a whole, the refrigerant is allowed to flow from the rear upper header 10*a* into the rear flat tubes 11*a* in uniformly divided streams.

The embodiments described above are limited only to those having a refrigerant diffusing portion 60, 61, 62 or 63 provided for the refrigerant inlet hole 27, whereas the refrigerant outlet hole 28 may similarly be provided with a refrigerant diffusion portion 60, 61, 62 or 63 having small holes 60*a*, 61*a*, 62*a* or 63*a*. Briefly stated, the refrigerant can be caused to flow as uniformly divided if at least one of the refrigerant inlet hole 27 and outlet hole 28 is provided with the refrigerant diffusing portion 60, 61, 62 or 63. The small holes 60*a*, 61*a*, 62*a*, or 63*a* may of course be distributed uniformly, but can be in a nonuniform arrangement or may be differ in diameter.

The illustrated layered evaporator 1 is of the type wherein the intermediate plates 2 have headers 10, 12 at both upper and lower sides thereof, whereas the layered evaporator 1 of the invention can also be of the type wherein each intermediate plate 2 has headers at one of upper and lower sides thereof.

The layered heat exchanger according to the present invention is not only useful as an evaporator for motor vehicle air conditioners but is also similarly useful in oil coolers, aftercoolers, radiators, etc.

The layered heat exchanger according to the present invention is usable also as an evaporator constituting refrigeration systems. FIG. 9 shows such an embodiment.

FIG. 9 shows a refrigeration system 70 which comprises the layered heat exchanger described for use as an evaporator 71, compressor 72, condenser 73, receiver 74, an expansion valve 75 serving as a pressure reducing device, temperature sensor tube 76, etc.

With this refrigeration system 70, a refrigerant in a gas phase is compressed by the compressor 72 to become a gaseous refrigerant having a high temperature and high pressure, which is sent to the condenser 73, in which the refrigerant is converted to a liquid-phase refrigerant by being cooled with an air stream or fan. The liquid refrigerant of high pressure is sent via the receiver 74 to the expansion valve 75 to abruptly expand and is then sent to the evaporator 71. The degree of opening of the expansion valve 75 is adjusted by the temperature sensor tube 76, such that if the refrigerant temperature at the outlet of the evaporator 71 is high, the refrigerant flow rate is increased, while if the refrigerant is cooled to excess, the refrigerant flow rate is decreased. The refrigerant in the evaporator 71 is converted to a gas phase by absorbing ambient heat, producing a cooling effect by absorbing a large quantity of heat on vaporization to become a gaseous refrigerant of low pressure again and return to the compressor 72. In the interior of the evaporator 71, the refrigerant diffusing portion 60, 61, 62 or 63 provided over the refrigerant inlet hole 27 and/or the refrigerant outlet hole 28 formed in the end plate 20 effectively diffuses the refrigerant as previously described for the entire system to achieve an improved efficiency.

What is claimed is:

1. A layered heat exchanger comprising a multiplicity of intermediate plates arranged side by side, and a pair of end plates disposed respectively at left and right sides of the arrangement, each of the intermediate plates having an upper header forming portion provided with a pair of front and rear fluid passage holes and a tube forming recessed portion, the multiplicity of intermediate plates being fitted together in juxtaposed layers, with the recessed portion of each intermediate plate opposed to the recessed portion of the intermediate plate immediately adjacent thereto to thereby provide juxtaposed flat tubes and a front and a rear upper header interconnecting the flat tubes, one of the end plates having a fluid inlet through hole in communication with one of the front and rear upper headers and a fluid outlet through hole in communication with the other upper header, the layered heat exchanger being characterized in that at least one of the two through holes formed in the end plate is at least partly covered with a fluid diffusing portion having a plurality of small holes, wherein the through hole covered with the fluid diffusing portion is circular, and the fluid diffusing portion has a spherical surface.

2. A layered heat exchanger according to claim 1 wherein one of the two through holes is covered with the fluid diffusing portion.

3. A layered heat exchanger according to claim 1 wherein each of the two through holes is covered with the fluid diffusing portion.

4. A layered heat exchanger according to claim 1 wherein the fluid diffusing portion is disposed at the lower half of each of the through holes.

5. A layered evaporator for motor vehicle air conditioners which comprises a multiplicity of intermediate plates arranged side by side, and a pair of end plates disposed respectively at left and right sides of the arrangement, each of the intermediate plates having an upper header forming portion provided with a pair of front and rear fluid passage holes and a tube forming recessed portion, the multiplicity of intermediate plates being fitted together in juxtaposed layers, with the recessed portion of each intermediate plate opposed to the recessed portion of the intermediate plate immediately adjacent thereto to thereby provide juxtaposed flat tubes and a front and a rear upper header interconnecting the flat tubes, one of the end plates having a fluid inlet through hole in communication with one of the front and rear upper headers and a fluid outlet through hole in communication with the other upper header, the layered evaporator being characterized in that at least one of the two through holes formed in the end plate is at least partly covered with a fluid diffusing portion having a plurality of small holes, wherein the through hole covered with the fluid diffusing portion is circular, and the fluid diffusing portion has a spherical surface.

6. A layered evaporator for motor vehicle air conditioners according to claim 5 wherein one of the two through holes is covered with the fluid diffusing portion.

7. A layered evaporator for motor vehicle air conditioners according to claim 5 wherein each of the two through holes is covered with the fluid diffusing portion.

8. A layered evaporator for motor vehicle air conditioners according to claim 5 wherein the fluid diffusing portion is disposed at the lower half of each of the through holes.

9. A refrigeration system comprising a compressor for compressing a refrigerant, a condenser for condensing the compressed refrigerant, a pressure reducing device for passing the condensed refrigerant therethrough for a pressure reduction, and an evaporator having a refrigerant diffusing function for evaporating the refrigerant from the device to return the resulting refrigerant to the compressor, the evaporator comprising a multiplicity of intermediate plates arranged side by side, and a pair of end plates disposed respectively at left and right sides of the arrangement, each of the intermediate plates having an upper header forming portion provided with a pair of front and rear fluid passage holes and a tube forming recessed portion, the multiplicity of intermediate plates being fitted together in juxtaposed layers, with the recessed portion of each intermediate plate opposed to the recessed portion of the intermediate plate immediately adjacent thereto to thereby provide juxtaposed flat tubes and a front and a rear upper header interconnecting the flat tubes, one of the end plates having a fluid inlet through hole in communication with one of the front and rear upper headers and a fluid outlet through hole in communication with the other upper header, the refrigeration system being characterized in that at least one of the two through holes formed in the end plate is at least partly covered with a fluid diffusing portion having a plurality of small holes, wherein the through hole covered with the fluid diffusing portion is circular, and the fluid diffusing portion has a spherical surface.

10. A refrigeration system according to claim 9 wherein one of the two through holes is covered with the fluid diffusing portion.

11. A refrigeration system according to claim 9 wherein each of the two through holes is covered with the fluid diffusing portion.

12. A refrigeration system according to claim 9 wherein the fluid diffusing portion is disposed at the lower half of each of the through holes.

* * * * *